United States Patent [19]

Willis

[11] Patent Number: 4,544,073

[45] Date of Patent: Oct. 1, 1985

[54] BOTTLE-OVERCAP COMBINATION

[75] Inventor: Donald E. Willis, Hazelwood, Mo.

[73] Assignee: Bristol-Myers Company, New York, N.Y.

[21] Appl. No.: 575,099

[22] Filed: Jan. 30, 1984

[51] Int. Cl.[4] ..... B65D 51/18

[52] U.S. Cl. ..... 215/246; 215/277; 215/321; 215/12 R; 220/257

[58] Field of Search ..... 215/277, 321, 246, 230, 215/12 R; 220/256, 257, 258

[56] References Cited

U.S. PATENT DOCUMENTS

| | | | |
|---|---|---|---|
| 1,280,700 | 10/1918 | Fouche | 215/230 X |
| 1,664,147 | 3/1928 | Wood . | |
| 2,121,041 | 6/1938 | Morgan | 41/41 |
| 2,223,017 | 11/1940 | Abrams et al. | 226/80 |
| 2,361,464 | 10/1944 | Edwards et al. | 215/246 |
| 2,734,650 | 2/1956 | Meyer | 215/246 |
| 3,029,973 | 4/1962 | Burchett | 220/258 |
| 3,088,830 | 5/1963 | Graham | 215/12 R |
| 3,374,911 | 3/1968 | White | 215/12 R |
| 3,696,957 | 10/1972 | Van Baarn | 215/321 X |
| 3,811,591 | 5/1974 | Novitch | 215/12 R |
| 3,827,591 | 8/1974 | Spelman et al. | 215/246 |
| 3,951,292 | 4/1976 | Amberg | 215/230 |
| 4,150,761 | 4/1979 | Collins | 215/228 |
| 4,177,905 | 11/1979 | Winchill et al. | 215/246 |
| 4,227,616 | 10/1980 | Lecinski et al. | 215/246 |
| 4,230,230 | 10/1980 | Mumford | 215/277 X |
| 4,273,247 | 6/1981 | Earls | 215/228 |

*Primary Examiner*—Donald F. Norton
*Attorney, Agent, or Firm*—Gabriel P. Katona

[57] ABSTRACT

A bottle and overcap combination in which the combination has a unitary, uninterrupted cylindrical appearance, the combination also being provided with tamper resistant features.

5 Claims, 6 Drawing Figures

FIG. 1
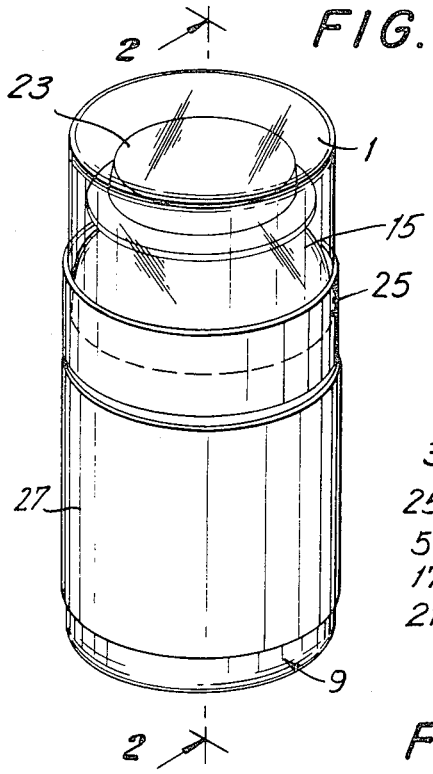
FIG. 2
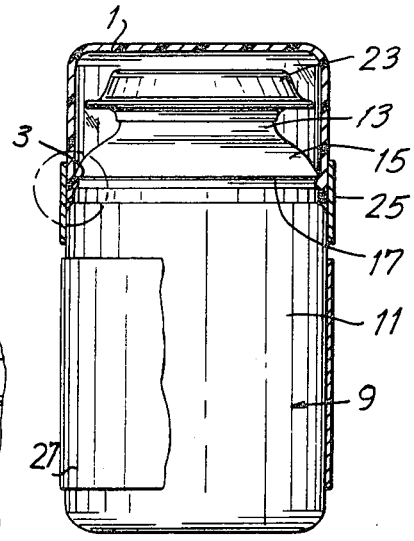
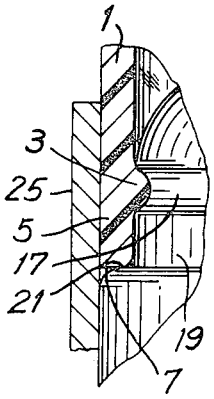
FIG. 6
FIG. 3
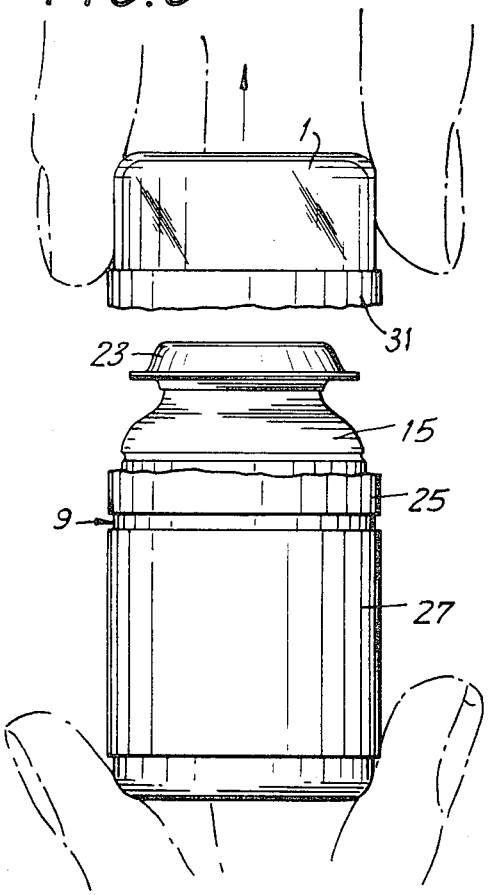
FIG. 4
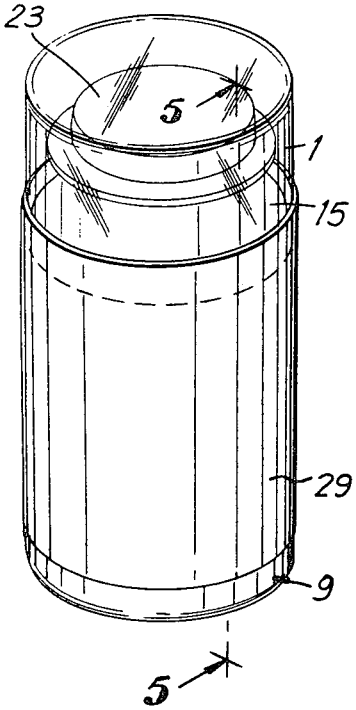
FIG. 5
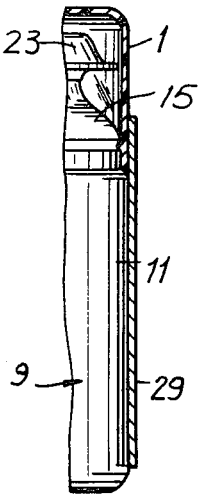

BOTTLE-OVERCAP COMBINATION

DESCRIPTION

BACKGROUND OF INVENTION

This invention relates to a bottle and overcap combination. More particularly, it concerns a combination of this character which gives a unitary, uninterrupted cylindrical appearance when the parts are assembled. It is also directed to a tamper resistant package having these characteristics.

It is known in the prior art to provide bottle and closure assemblies with an overcap. Typical of this kind of prior art is the U.S. Pat. No. 4,273,247, to Earls. Somewhat similar constructions are shown in the U.S. Pat. Nos. 1,280,700; 4,230,230 and 4,150,760. These, however, fail to show the combination described and claimed in more detail below.

SUMMARY OF INVENTION

The present invention is a bottle and overcap combination that is characterized by the fact that it gives a unitary, uninterrupted, cylindrical appearance when the parts are assembled. The overcap is provided with a lower margin that seats on a ledge cut into the bottle. An undercut is provided on the bottle which mates with a bead disposed on the inner surface of the overcap. This enables the overcap to be snap fitted onto the bottle.

In a preferred form of this invention, the bottle is also provided with a tamper resistant closure and a bottle overcap arrangement that is also tamper resistant. The present combination accordingly may be used to package medicines and drugs in a safe fashion.

BRIEF DESCRIPTION OF THE DRAWINGS

For a further understanding of the invention, reference is made to the following description taken in connection with the accompanying drawings in which:

FIG. 1 is a perspective view of an embodiment of the present invention; the overcap being shown as being transparent;

FIG. 2 is a longitudinal cross sectional view taken along line 2—2 of FIG. 1;

FIG. 3 is a perspective view of the embodiment shown in FIG. 1 in which the overcap is shown being removed;

FIG. 4 is a perspective view of another modification of this invention;

FIG. 5 is a partial longitudinal cross sectional view of the modification shown in FIG. 4 taken along line 5—5 of FIG. 4;

FIG. 6 is an enlarged partial view of the modification of this invention shown in FIG. 2 of the area encompassed in dotted line.

DESCRIPTION OF PREFERRED EMBODIMENTS

Referring now to FIGS. 1, 2 and 6, the overcap is shown generally at 1 and is cylindrical in shape. In the modification shown in these figures the overcap is illustrated as being transparent. It is understood, however, that it might also be opaque.

Near its lower margin but spaced therefrom, overcap 1 is provided with a bead 3 projecting inwardly from the inner surface of overcap 1. Bead 3 may go completely around the inner circumference of overcap 1 or may be formed as an interrupted bead formed, for example, as two semi-circular portions.

Extending downwardly from bead 3, overcap 1 is provided with a lower terminal margin, which is perpendicular to the wall of overcap 1. Terminal margin 7 seats on a ledge cut in the bottle 9 as described in more detail below.

Overcap 1 can be molded as a unitary piece from any of a variety of materials. In a preferred form of this invention, this is molded from Polystyrene, Polyethylene or Polypropylene.

Bottle 9 comprises a body portion 11 and a neck portion 13 that are joined together by a shoulder portion 15. Near the lower end of shoulder 15 a groove 17 is cut around the entire circumference of shoulder 15. This forms an undercut which receives bead 3 of overcap 1 when the latter is snapped into position on bottle 9. Extending downwardly from the lower margin of groove 17 is an annular marginal portion 19. At the juncture of shoulder portion 15 of bottle 9 and the upper margin of body 11 the outer diameter of annular margin 19 is smaller than the outer diameter of body 11. This relationship forms a seat 21 on which terminal margin 7 of overcap 1 rests when the latter is snapped into position on bottle 9.

Bottle 9 is provided with a closure 23. In a preferred form of this invention a shrink band is disposed around closure 23 and bottle 9. This serves as a tamper resistant feature in the present assembly. A rupture of the shrink band would indicate that the bottle may have been tampered with.

Surrounding the juncture of the bottle and overcap, there is disposed a shrink sleeve 25. As described in more detail below, this also serves as a tamper resistant feature. If desired, bottle 9 may also be provided with a separate label 27.

FIG. 3 illustrates one of the tamper resistant features of this invention. As shown in this Fig. the overcap 1 is being removed from bottle 9. In doing this, shrink sleeve 25 is fractured showing an irregular fracture line 31. Even if the overcap were replaced into position on bottle 9 the irregular fracture line would alert the user to the fact that the package has been tampered with.

In the modification illustrated in FIGS. 4 and 5 a unitary shrink sleeve and label combination 29 is employed. This is distinguished from the previous modification in that in the former a separate shrink sleeve and label are provided for. In all other respects, the modification shown in FIGS. 4 and 5 are the same as that shown in FIGS. 1 to 3. In this modification when the overcap is grasped and removed an irregular fracture line will also be developed in the combination label and shrink sleeve 29. The user of the package will thus be advised of the fact that the overcap 1 has been previously removed.

Although the invention has been described with reference to specific forms thereof, it will be understood that many changes and modifications may be made without departing from the spirit of this invention.

What is claimed is:

1. A bottle and overcap combination designed to give this combination a unitary, uninterrupted, cylindrical appearance when the parts are assembled;

(a) said bottle being provided with a closure and comprising an upper bottle portion and a lower cylindrical body portion having an upper margin, the outside dimension of said upper bottle portion at its greatest horizontal dimension being smaller than the outside diameter of said bottle body portion, said bottle body portion at its upper margin terminating in a seat that extends inwardly and which is adapted to serve as a seat for a lower margin provided for in said overcap; said upper bottle portion having an undercut in its surface near its lower end, said undercut being spaced apart vertically from said seat;

(b) said overcap being cylindrical in form and having an outer diameter that is substantially the same at the outer diameter of said bottle body portion, said overcap being formed with an inner surface having a bead extending inwardly of said overcap inner surface, said bead being spaced vertically from the lower margin of said overcap and positioned so as to engage the undercut on said upper bottle portion when said overcap is snapped into position on said bottle, whereby when said overcap is positioned on said bottle the combination has the appearance of a unitary uniterrupted cylinder.

2. A bottle and overcap combination according to claim 1 in which said upper bottle portion comprises a cylindrical neck and a shoulder, said shoulder terminating at its lower end in said undercut.

3. A bottle and overcap combination according to claim 2 in which said undercut and said seat are spaced apart from each other by a vertically extending narrow annular section that extends upwardly from the inner end of said seat to the lower margin of said undercut.

4. A bottle and overcap combination according to claims 1, 2 or 3 which is tamper resistant, said closure on said bottle being provided with a shrink band to resist the tampering with the contents of said bottle, said bottle and overcap combination having a shrink sleeve applied to it that covers the junction of said bottle with said overcap, whereby when the overcap is removed from the bottle, the shrink sleeve is fractured which would indicate that the package had been previously opened.

5. A bottle and overcap combination according to claims 1, 2 or 3 which is tamper resistant, said closure on said bottle being provided with a shrink band to resist the tampering with the contents of said bottle, said bottle and overcap combination having a unitary shrink sleeve and label combination applied to it that covers the junction of said bottle with said overcap, whereby when the overcap is removed from the bottle, the unitary shrink sleeve and label combination is fractured which would indicate that the package had been previously opened.

* * * * *